US007053592B2

(12) United States Patent
Pihet et al.

(10) Patent No.: US 7,053,592 B2
(45) Date of Patent: May 30, 2006

(54) OUTPUT LEVEL RESPONSIVE SWITCHING ON/OFF OF A LINEAR REGULATOR

(75) Inventors: Eric Pihet, München (DE); Josef Gerner, Moosburg (DE)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 10/446,603

(22) Filed: May 28, 2003

(65) Prior Publication Data

US 2004/0004469 A1 Jan. 8, 2004

(30) Foreign Application Priority Data

May 28, 2002 (DE) ..... 102 23 772

(51) Int. Cl.
*G05F 1/40* (2006.01)

(52) U.S. Cl. ..... 323/266; 323/274

(58) Field of Classification Search ..... 323/284, 323/283, 274, 280, 281, 266
See application file for complete search history.

(56) References Cited

U.S. PATENT DOCUMENTS 4,725,769 A * 2/1988 Cini et al. ..... 323/283
5,654,628 A * 8/1997 Feldtkeller ..... 323/282
6,158,012 A * 12/2000 Watts, Jr. ..... 713/322
6,201,375 B1 * 3/2001 Larson et al. ..... 323/277
6,226,190 B1 * 5/2001 Balakrishnan et al. ... 363/21.13
6,388,433 B1 * 5/2002 Marty ..... 323/284
2002/0121883 A1 9/2002 Bartenschlager et al.

FOREIGN PATENT DOCUMENTS

DE 695 11 930 T2 10/1995
DE 101 10 273 A1 9/2002
EP 0 678 963 A2 10/1995

OTHER PUBLICATIONS

Infineon Technologies: Fault Tolerant CAN-LDO TLE 6262 G, Final Data Sheet, Version, 2.03, dated Mar. 20, 2003.

* cited by examiner

*Primary Examiner*—Shawn Riley
(74) *Attorney, Agent, or Firm*—Laurence A. Greenberg; Werner H. Stemer; Ralph E. Locher

(57) ABSTRACT

A circuit configuration provides an output voltage from an input voltage. The circuit configuration has a voltage regulator with an input terminal for receiving an input voltage, an output terminal for providing an output voltage, and drive input for receiving a drive signal. A drive circuit is coupled to the drive input and switches the voltage regulator on and off in a clocked manner according to a state signal.

16 Claims, 5 Drawing Sheets

OUTPUT LEVEL RESPONSIVE SWITCHING ON/OFF OF A LINEAR REGULATOR

BACKGROUND OF THE INVENTION

Field of the Invention

The present invention relates to a circuit configuration having a voltage regulator for providing an output voltage from an input voltage and to a method for providing the output voltage from the input voltage using a voltage regulator. The invention relates, in particular, to a device and a method for use in system ICs or in system modules.

One example of an IC with a conventional circuit configuration for providing a supply voltage from a battery voltage is the Applicant's integrated CAN transceiver TLE 6262 G, which is described for example in the data sheet: TLE 6262 G, version 2.01 of 12.02.2002. The module contains a linear voltage regulator with a transistor whose load path is connected between an input terminal, at which a battery voltage is present, and an output terminal, at which the desired supply voltage is present. The TLE 6262 G serves, inter alia, to supply a voltage to a microcontroller and as a transceiver module for the microcontroller. The TLE 6262 G has a connection terminal at which a supply voltage provided by the voltage regulator is present for the microcontroller.

There are applications in which the microcontroller and also the module which undertakes the voltage supply thereof are intended to have a current consumption that is as low as possible.

Various voltage regulator concepts have been disclosed hitherto for this purpose. In one known voltage regulator concept, the voltage regulator in the voltage supply module is completely switched off, the current or voltage supply of functional blocks which absolutely have to be supplied during this so-called low-power mode in the voltage supply module are supplied by a further internal current supply with a low current consumption. What is disadvantageous in this case is that a connected microcontroller is no longer supplied, and that a comparatively long latency elapses after the occurrence of an event upon which the microcontroller is supposed to start again.

A further voltage regulator concept provides for the voltage regulator to be left switched on even in the state of low current consumption, in which case, in order to reduce the current consumption, functional units in the voltage supply module or voltage supply IC which contains the voltage regulator and, if appropriate, functional units in a microcontroller connected thereto are switched off, so that the voltage regulator is subject to a lower current loading and the power consumption is reduced. This concept is employed for example in the TLE 6262 G mentioned above.

What is disadvantageous in this case is that modules such as the TLE 6262 G with a connected microcontroller have a current consumption of about 200 μA even in the state of low current consumption (in the low-power mode), which is still too high for some applications, for example in the automotive industry.

SUMMARY OF THE INVENTION

It is accordingly an object of the invention to provide a circuit configuration and a method for providing an output voltage from an input voltage that overcomes the above-mentioned disadvantages of the prior art devices and methods of this general type, which reduces the power consumption of the circuit configuration in a state of low power consumption in comparison with known circuit configurations of this type, but an output voltage for supplying small loads is nevertheless provided.

With the foregoing and other objects in view there is provided, in accordance with the invention, a circuit configuration for providing an output voltage from an input voltage. The circuit configuration contains a voltage regulator having an input terminal for receiving the input voltage, an output terminal for providing the output voltage, and a drive input for receiving a drive signal. A drive circuit is coupled to the drive input and switches the voltage regulator on and off in a clocked manner according to a state signal.

The present invention makes use of the insight that, in known voltage regulators, for example in the voltage regulator in the integrated module TLE 6262 G, the comparatively high input current even in the state of low power consumption, that is to say when components within the integrated module which undertakes, inter alia, the voltage supply of connected components and, if appropriate, within a connected microcontroller are switched off, results from the fact that the voltage regulator is permanently switched on. The power consumption in the circuit configuration according to the invention is reduced by virtue of the fact that the voltage regulator is switched on and off in a clocked manner in the state of low power consumption, which is prescribed by the state signal, as a result of which the power consumption is reduced overall. A voltage or current supply of components with a low power consumption is still ensured, however. The state signal which prescribes whether the voltage regulator is to be permanently switched on, that is to say is not to be operated in the state of low power consumption, or is to be switched on and off in a clocked manner, that is to say is to be operated in the state of low power consumption, can be generated in any desired manner. When the circuit configuration according to the invention is used in an integrated module, for example in a module of the type of the TLE 6262 G, the generation of the state signal can be generated by an external circuit, for example a connected microcontroller which supplies a signal according to which the state signal is generated to an input/output unit of the integrated module.

A wide variety of concepts can be used for the clocked switching-on and switching-off of the voltage regulator.

In a first embodiment, it is provided that the drive circuit switches the voltage regulator on whenever the output voltage has fallen to a predetermined threshold value, and that the drive circuit switches the voltage regulator off again always for a predetermined time duration after the switch-on. For this purpose, the drive circuit has, for example, a comparator for comparing the output voltage with a reference value, an output signal of the comparator being fed to a delay element, on which the drive signal is dependent. The drive signal and the state signal are preferably fed to a logic circuit which, depending on the value of the state signal, allows the drive signal "to pass through", in order to switch the voltage regulator on and off in a clocked manner, or switches the voltage regulator permanently on or off.

In a further embodiment of the invention, it is provided that the drive circuit switches the voltage regulator on and off periodically according to an oscillator signal if the state signal assumes a value at which the voltage regulator is intended to undergo transition to the state of low power consumption. For this purpose, the drive circuit contains an oscillator, for example, which provides an oscillator signal, on which the drive signal is dependent. According to the state signal, the oscillator signal is forwarded as drive signal for the clocked switching-on and off of the voltage regulator.

In a further embodiment, it is provided that the drive circuit switches the voltage regulator on, according to the state signal, if the output voltage has fallen to a first threshold value, and that the drive circuit switches the voltage regulator off, according to the state signal, if the output voltage has risen to a second threshold value. For this purpose, there are preferably provided in the drive circuit a first comparator, which compares the output voltage with a first threshold value and which provides a first comparator signal, and a second comparator, which compares the output voltage with a second threshold value and which provides a second comparator signal, the comparator signals being fed to a flip-flop, which provides an output signal, on which the drive signal is dependent.

The voltage regulator is preferably a voltage regulator having a controllable resistor, whose load path is connected between the input terminal and the output terminal, and which has a comparator configuration, which drives the controllable resistor in a manner dependent on a comparison of the output voltage with a reference voltage in order thereby to regulate the output voltage.

The controllable resistor is preferably a transistor, whose load path is coupled between the input terminal and the output terminal and whose base or gate terminal is driven by the comparator configuration. In order to be able to switch the voltage regulator on and off in a clocked manner for the purpose of reducing the power consumption, one embodiment provides for the control terminal of the controllable resistor to be connected to a reference-ground potential via a switch. The voltage regulator being switched on, that is to say providing an output voltage, or being switched off, that is to say providing no output voltage, depending on the switch position of the switch. The switch is driven by the drive signal provided by the drive circuit according to the state signal.

In a further embodiment, it is provided that the reference voltage source that supplies the reference voltage with which the comparator configuration compares the output voltage is driven by the drive signal. The drive signal for switching off the voltage regulator sets the output signal of the reference voltage source to zero, for example, in order thereby to interrupt the voltage regulation of the voltage regulator. It is also possible to realize both concepts simultaneously, that is to say first to drive the reference voltage source by the drive signal and additionally to provide a switch connected between the control terminal of the controllable resistor or the transistor and a reference-ground potential.

A method for providing an output voltage from an input voltage provides for a voltage regulator that can be switched on and off to be provided and for the voltage regulator to be switched on and off in a clocked manner according to a state signal.

In this case, one embodiment of the method provides for the voltage regulator to be switched on whenever the output voltage has fallen to a predetermined threshold value, and the voltage regulator to be switched off again for a predetermined time duration after the switch-on.

A further embodiment provides for the voltage regulator to be switched on and off periodically according to an oscillator signal. A further embodiment provides for the voltage regulator to be switched on whenever the output voltage has fallen to a first predetermined threshold value, and the voltage regulator to be switched off again when the output voltage has risen to a second predetermined threshold value.

Other features which are considered as characteristic for the invention are set forth in the appended claims.

Although the invention is illustrated and described herein as embodied in a circuit configuration and a method for providing an output voltage from an input voltage, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
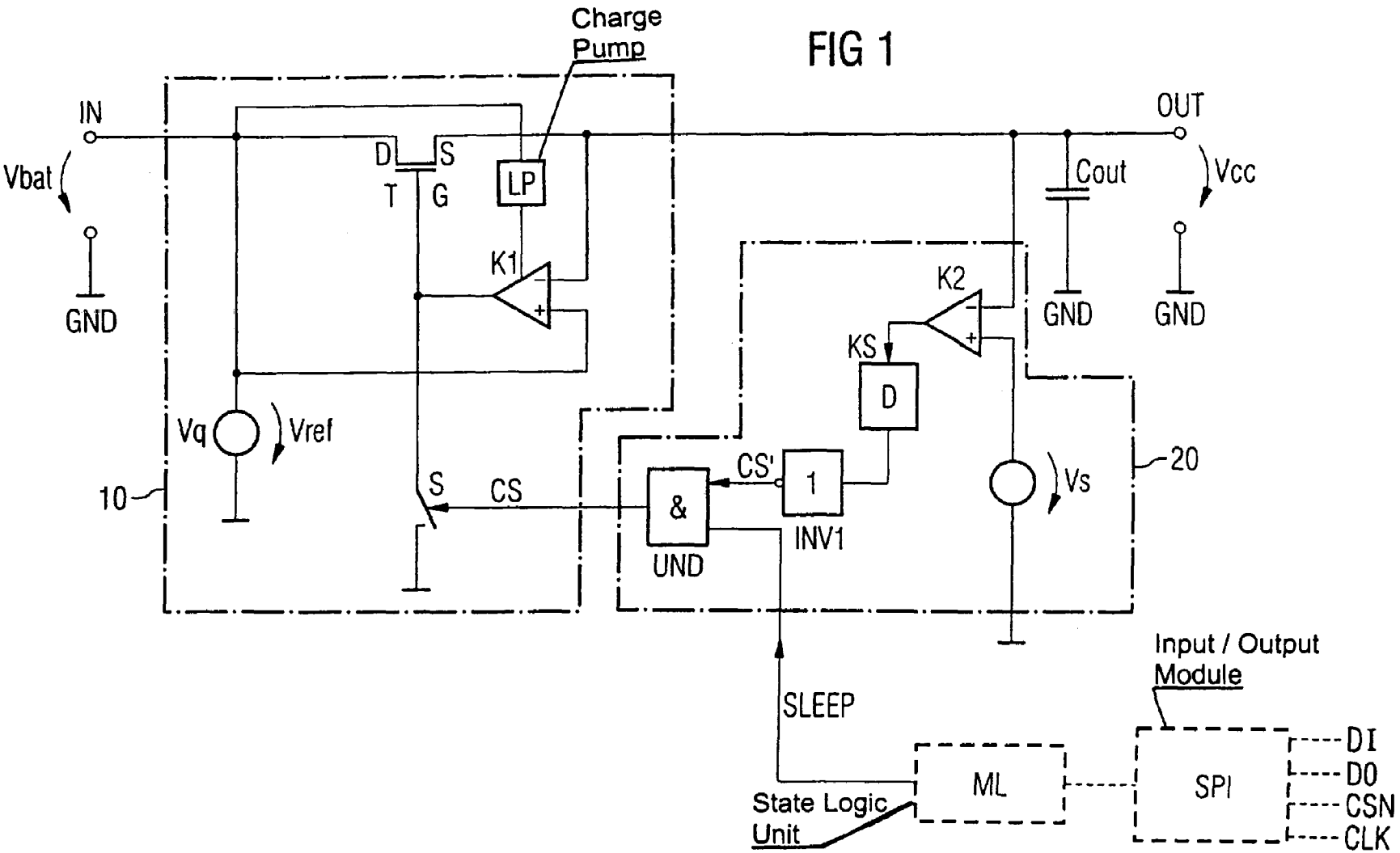
FIG. 1 is a circuit diagram of a first embodiment of a circuit configuration according to the invention for providing an output voltage from an input voltage.

In all the figures of the drawing, sub-features and integral parts that correspond to one another bear the same reference symbol in each case. Referring now to the figures of the drawing in detail and first, particularly, to FIG. 1 thereof, there is shown a circuit diagram of a first embodiment of a circuit configuration according to the invention for providing an output voltage Vcc from an input voltage Vbat. The circuit configuration contains an input terminal IN, to which the input voltage Vbat can be applied with respect to a reference-ground potential GND, and an output terminal OUT, at which the output voltage Vcc can be tapped off with respect to the reference-ground potential GND. For the purpose of buffering the output voltage Vcc, an output capacitor Cout is provided in the exemplary embodiment, the capacitor Cout being connected between the output terminal OUT and reference-ground potential GND.

The circuit configuration contains a voltage regulator 10, which is connected between the input terminal IN and the output terminal OUT and, in the exemplary embodiment, has a MOS transistor T, whose drain-source path D-S is connected between the input terminal IN and the output terminal OUT and whose gate terminal G is driven by a comparator configuration having a differential amplifier K1 and a reference voltage source Vq, which supplies a reference voltage Vref. The reference voltage Vref is fed to the differential amplifier K1 at its non-inverting input, while an inverting input of the differential amplifier K1 is connected to the output terminal OUT for detecting the output voltage Vcc. In order also to be able to generate output voltages Vcc which are only a little less than the input voltage Vbat, a charge pump LP is connected to the differential amplifier K1, which undertakes the voltage supply of the differential amplifier K1 and has the effect that output signals of the comparator K1 may be greater than the potentials on the load paths of the transistor T in order that, as a result, the transistor T can, if appropriate, be completely turned on. The voltage regulator 10 illustrated functions as a linear regulator, the transistor T always being driven by the comparator configuration K1, Vq, LP such that the voltage drop across its load path has a magnitude precisely such that the desired output voltage Vcc dependent on the reference voltage Vref is present at the output.

The voltage regulator 10 illustrated in FIG. 1 can be switched on and off. A switch S is provided for this purpose, which switch S is connected between the gate terminal of the transistor T and the reference-ground potential GND and is driven by a drive signal CS. If the switch S is closed in the exemplary embodiment, then the gate of the transistor T is connected to reference-ground potential and the for example n-conducting transistor T is in the off state, as a result of which the voltage regulator 10 is switched off. If the switch S is open, then the voltage regulator 10 is switched on and the comparator configuration with the differential amplifier K1 undertakes the driving of the transistor T for the purpose of setting the desired output voltage Vcc.

A drive circuit 20 is present for providing the drive signal CS, which drive circuit 20 switches the switch S and thus the voltage regulator 10 on and off in a clocked manner according to a state signal SLEEP.

The drive circuit 20 contains a comparator K2, which compares the output voltage Vcc with a threshold value Vs, a high level being present at the output of the comparator K2 in the exemplary embodiment if the output voltage Vcc has fallen to the value of the threshold signal Vs. The output signal of the comparator K2 is fed to a delay element D, downstream of which is connected an inverter INV1, at whose output a signal CS' is present. In the exemplary embodiment, the delay element D is configured in such a way that it forwards a rising edge of the comparator output signal KS directly to its output, while a falling edge of the comparator output signal KS is forwarded only after a predetermined delay time. In the exemplary embodiment, the signal CS' and the state signal SLEEP are fed to an And gate AND, at whose output the drive signal CS is present. The state signal SLEEP serves as a selection signal, a logic zero being present at the output of the And gate AND if the state signal SLEEP has a logic zero, the switch S then being permanently open and the voltage regulator 10 being permanently switched on.

If the state signal SLEEP assumes the value of a logic 1, then the value of the signal CS' present at the output of the inverter INV1 is always forwarded as the drive signal and the switch S, and thus the voltage regulator, is switched on and off according to the signal CS'.

The method of operation of the circuit configuration is explained below with reference to FIG. 3 for the state of reduced current consumption, that is to say when the state signal SLEEP assumes the value of a logic 1.

If the voltage regulator 10 is switched off because the switch S is switched on, and if the output voltage Vcc falls to the value of the threshold voltage Vs, then the output signal of the comparator K2 assumes a high level and the signal CS' present at the output of the inverter INV1 assumes a low level. The low level of the signal CS' is forwarded to the switch S by the And gate AND in order to open the switch. When the switch S has been opened, the voltage regulator 10 is switched on and the output voltage Vcc present across the output capacitance Cout rises. The output signal of the comparator K2 falls to a low level again if the output voltage Vcc again exceeds the value of the threshold voltage Vs. However, the falling edge of the comparator output signal KS is forwarded only in a delayed manner by the delay element D, so that it is only after a delay time $t_{on}$ has elapsed that the switch S is switched on again, in order thereby to switch the voltage regulator 10 off.

The value of the voltage threshold Vs and the value of the switch-on duration $t_{on}$ are chosen in a manner dependent on the loading to which the voltage regulator 10 is subject in the state of low power consumption (in the so-called sleep mode).

The circuit configuration illustrated in FIG. 1 is preferably part of an integrated circuit having an input/output module SPI, which has an input DI for feeding in data, an input DO for outputting data, a clock input CLK and a chip select input CSN. Connected to the input/output module SPI is a state logic unit ML, which provides the state signal SLEEP in a manner dependent on a signal supplied by the input/output module SPI. Furthermore, a second non-illustrated switch may be provided in parallel with the switch S, to which a further logic unit is connected in order to permanently switch on the parallel switch, for example according to a further state signal, in order thereby to permanently switch off the voltage regulator 10.

It goes without saying that any desired further voltage regulators that can be switched on and off can be used in connection with the present invention.

Figure 2:
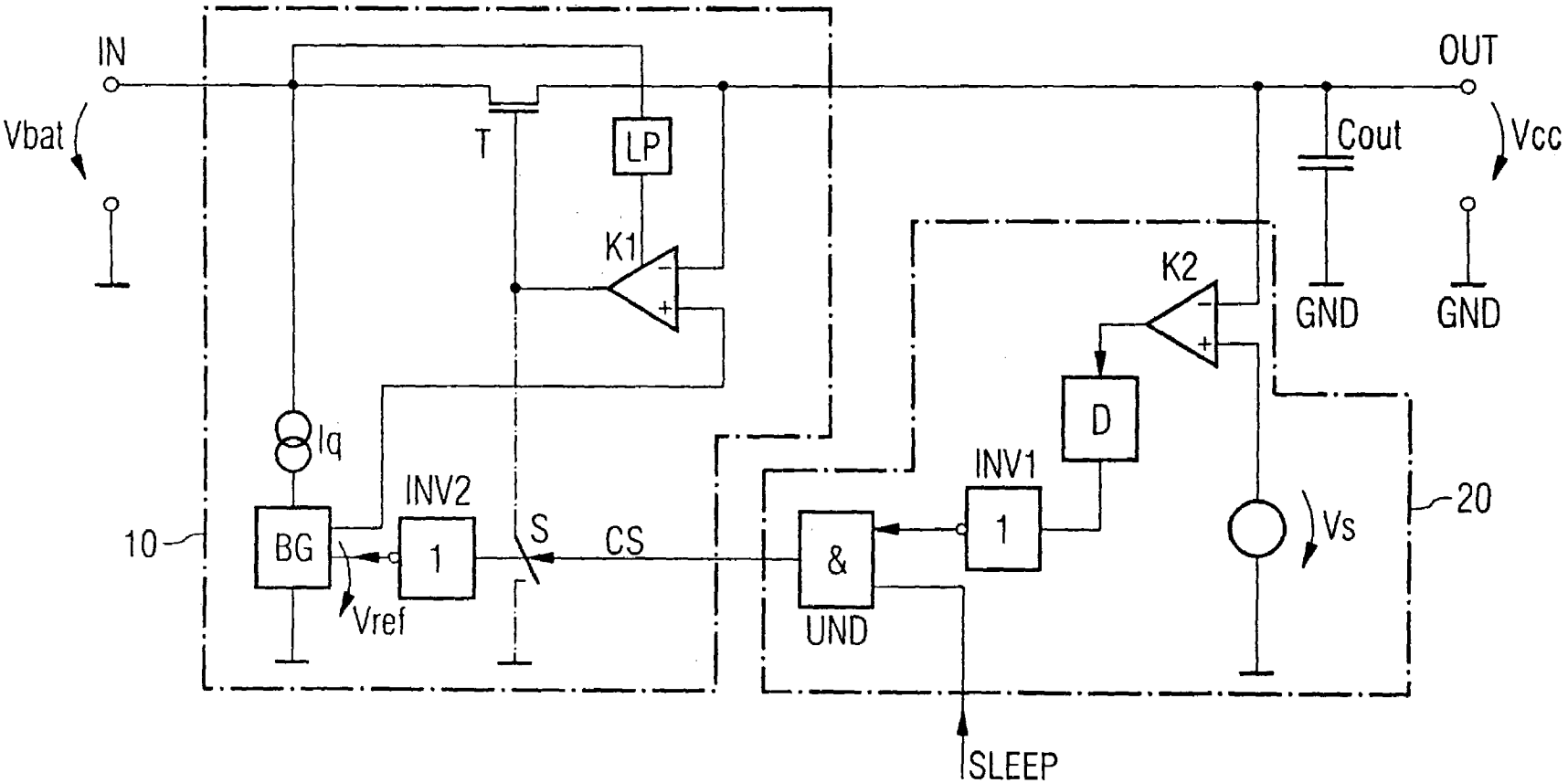
FIG. 2 is a circuit diagram of a modification of the circuit configuration shown in FIG. 1.

FIG. 2 shows another embodiment of the voltage regulator 10 that can be switched on and off. For providing the reference voltage Vref, the voltage regulator 10 has a circuit configuration with a current source Iq and a so-called bandgap reference circuit BG, the bandgap reference circuit BG has an output, at which the reference voltage Vref is present. The bandgap reference circuit BG has a further input, via which the bandgap reference circuit BG can be switched on and off, the bandgap reference circuit BG providing the reference voltage Vref in the switched-on state and providing no reference voltage in the switched-off state. In the exemplary embodiment, an inverted drive signal present at the output of an inverter INV2 is applied to the control input of the bandgap reference BG, the bandgap reference BG providing a reference voltage Vref when the signal present at its drive input has a high level.

The voltage regulator 10 is switched off if the bandgap reference does not supply a reference voltage.

Figure 3:
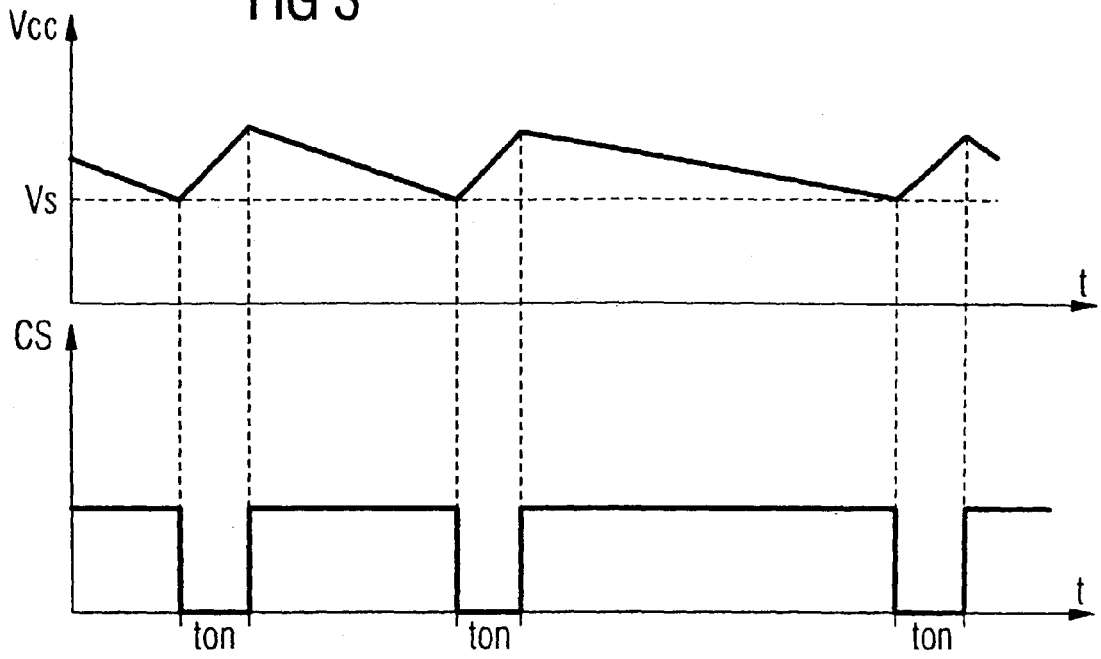
FIG. 3 is a graph showing exemplary temporal profiles of the output voltage of the circuit configuration and of a drive signal.

The temporal profile of the output voltage Vcc and of the drive signal CS corresponds to the temporal profile illustrated in FIG. 3, the reference voltage source BG being switched on if the output voltage Vcc has fallen to the value of the reference voltage Vs. In this case, the signal that is present at the control input of the reference voltage source BG and corresponds to the inverted drive signal CS assumes the value of a logic 1. The reference voltage source BG is switched off again after the switch-on duration ton has elapsed.

In addition to the switched reference circuit source BG, the switch S driven by the drive signal CS, which switch is already known from FIG. 1, may also be provided in the exemplary embodiment in accordance with FIG. 2.

Figure 4:
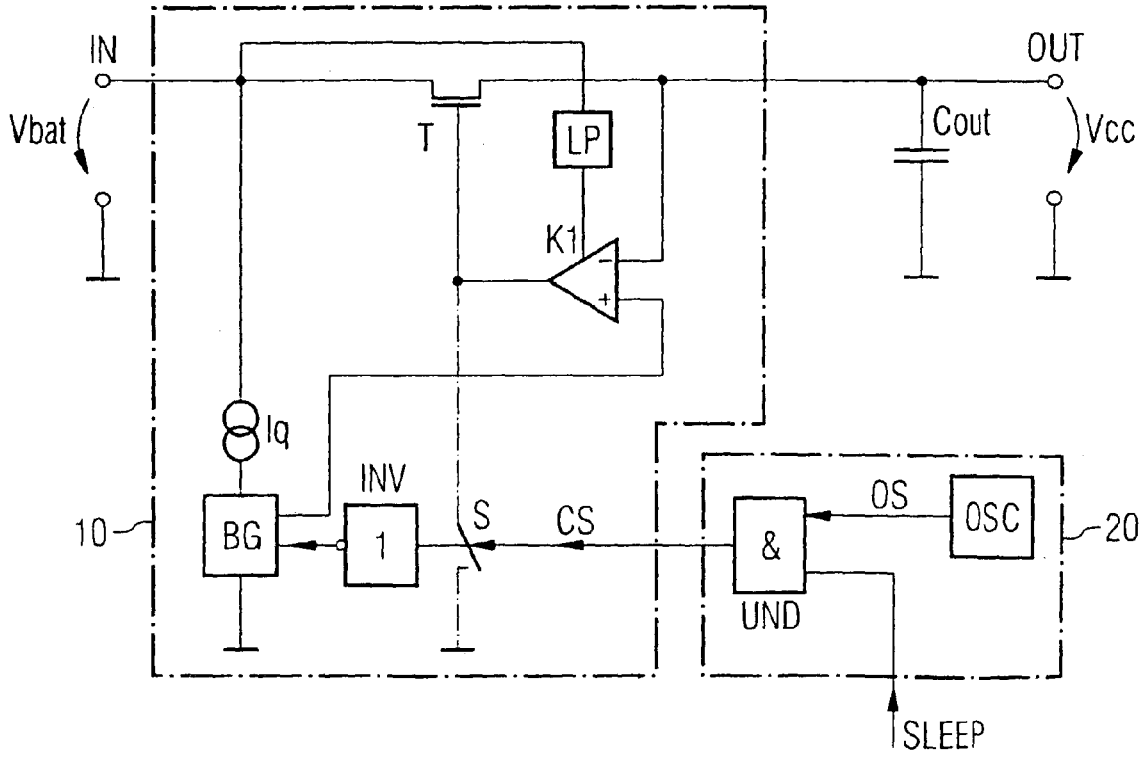
FIG. 4 is a circuit diagram of a second embodiment of the circuit configuration according to the invention.

FIG. 4 shows a further exemplary embodiment of the circuit configuration according to the invention, which differs from the circuit configuration illustrated in FIG. 3 in terms of the construction of the drive circuit 20. The drive circuit 20 in accordance with FIG. 4 contains an oscillator OSC, which provides an oscillator signal OS, which is combined with the state signal SLEEP by an And element AND connected downstream of the oscillator OSC, the oscillator signal OS being forwarded by the And element AND for driving the switch S and/or the reference voltage source BG if the state signal SLEEP assumes the value of a logic 1.

In contrast to the circuit configuration in accordance with FIGS. 1 and 2, in the exemplary embodiment in accordance with FIG. 4, the voltage regulator 10 is driven in a fixedly clocked manner depending on the oscillator signal in the state of reduced power consumption.

Figure 5:
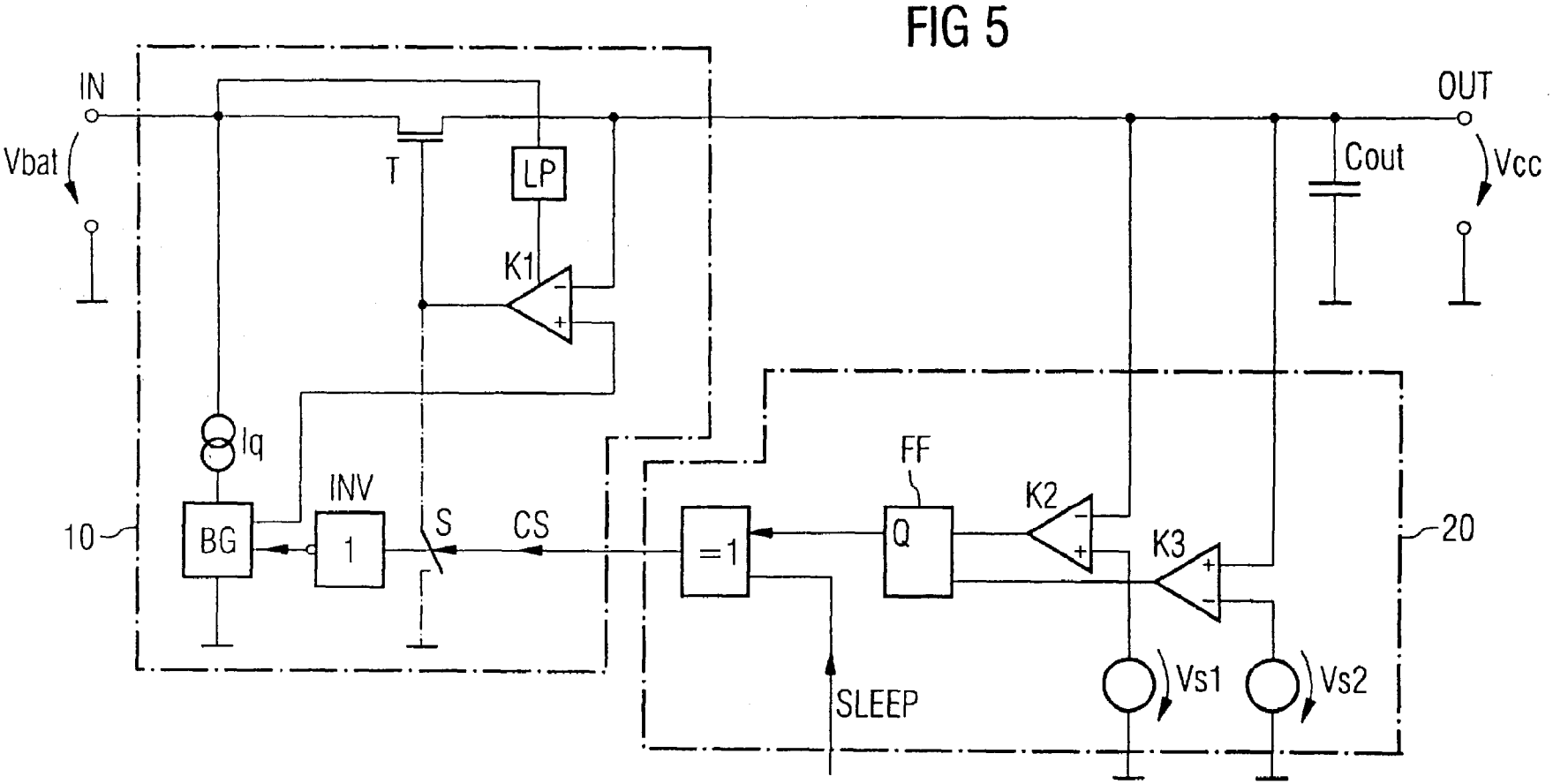
FIG. 5 is a circuit diagram of a third embodiment of the circuit configuration according to the invention.
Figure 6:
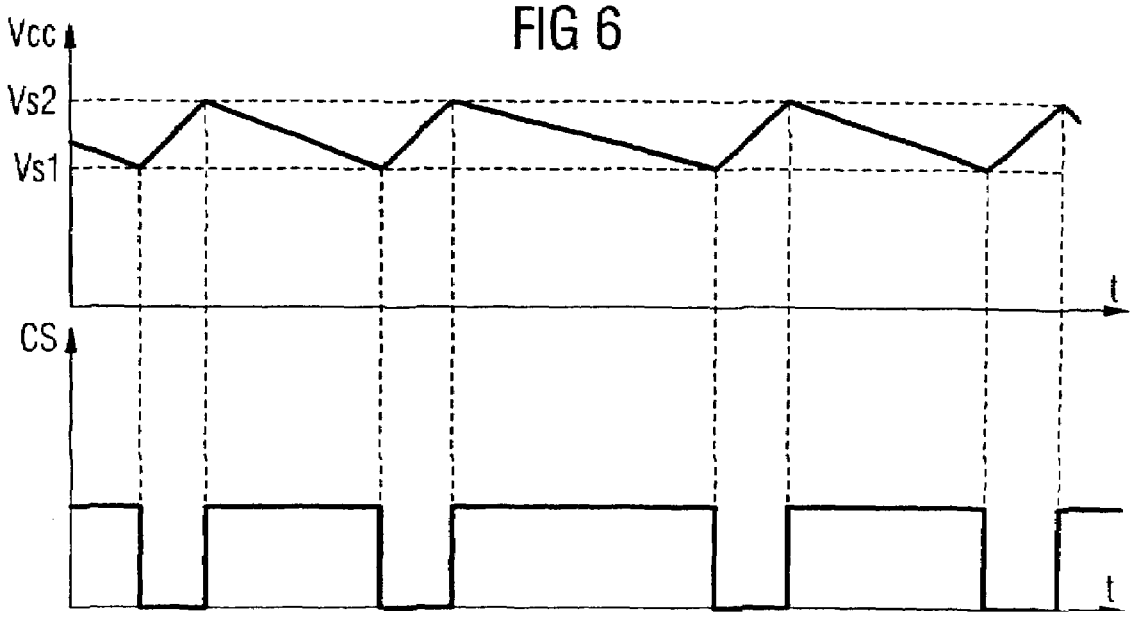
FIG. 6 is a graph showing temporal profiles of the output voltage and of the drive signal in the case of a circuit configuration in accordance with FIG. 5.

FIG. 5 shows the circuit configuration according to the invention with a further exemplary embodiment of the drive circuit, which drives the voltage regulator 10 in a manner dependent on the output voltage Vcc and two threshold voltages Vs1, Vs2. Two comparators K2, K3 are provided for this purpose, the first comparator K2 comparing the output voltage Vcc with a first threshold value Vs1 and the second comparator K3 comparing the output voltage Vcc with a second threshold value Vs2, the second threshold value Vs2 being greater than the first threshold value Vs1, as is also illustrated in FIG. 6. A high level is present at the output of the first comparator K2 if the output voltage Vcc has fallen to the value of the first voltage threshold Vs1, in which case the voltage regulator 10 is then to be switched on. In the exemplary embodiment, this is done by an RS flip-flop FF, to whose reset input R the output signal of the first comparator K2 is fed, the output signal present at the non-inverting output Q of the flip-flop FF driving the switch S and/or the reference voltage source BG via the And element AND. If the flip-flop FF is reset if the output voltage Vcc has fallen to the value of the first threshold voltage Vs1, then in the mode of reduced power consumption, that is to say if the state signal SLEEP assumes the value of a logic 1, the switch S is opened by the drive signal CS in order to switch the voltage regulator 10 on. The voltage regulator is switched off if the output voltage Vcc has risen above the value of the second voltage threshold Vs2, the output signal of the second comparator K2 then assuming the value of a logic 1 and setting the flip-flop FF, so that, by use of the And element AND and the drive signal CS, the switch S is closed in order to switch the voltage regulator 10 off. The output voltage Vcc then falls again in the event of a load connected to the output terminal OUT.

We claim:

1. A circuit configuration for providing an output voltage from an input voltage, comprising:

a linear voltage regulator having an input terminal for receiving the input voltage, an output terminal for providing the output voltage, and a drive input for receiving a drive signal, said voltage regulator being switched on or off, and said voltage regulator providing the output voltage in dependence on a reference voltage when switched on; and a drive circuit coupled to said drive input, said drive circuit receiving a state signal assuming one of a first and second signal level, said drive circuit permanently switching said voltage regulator on if the state signal assumes the first signal level and switching said linear voltage regulator on and off in a clocked manner if the state signal assumes the second signal level.

2. The circuit configuration according to claim 1, wherein said drive circuit switches said voltage regulator on if the output voltage has fallen to a threshold value, and switches said voltage regulator off a predetermined time duration after a switch-on.

3. The circuit configuration according to claim 2, wherein said drive circuit has a delay element and a comparator for comparing the output voltage with the threshold value, said comparator generating an comparator output signal being fed to said delay element, on which the drive signal is dependent.

4. The circuit configuration according to claim 3, wherein said delay element has an output and forwards to said output a change in the comparator output signal from a first to a second signal level in an undelayed manner and a change from the second signal level to the first signal level in a delayed manner.

5. The circuit configuration according to claim 1, wherein said drive circuit switches said voltage regulator on and off periodically according to an oscillator signal.

6. The circuit configuration according to claim 5, wherein said drive circuit has an oscillator generating the oscillator signal, on which the drive signal is dependent.

7. The circuit configuration according to claim 1, wherein said drive circuit switches said voltage regulator on if the output voltage has fallen to a first threshold value, and said drive circuit switches said voltage regulator off if the output voltage has risen to a second threshold value.

8. The circuit configuration according to claim 7, wherein said drive circuit has a flip-flop, a first comparator for comparing the output voltage with the first threshold value and outputting a first comparator signal, and a second comparator comparing the output voltage with the second threshold value and outputting a second comparator signal, the first and second comparator signals being fed to said flip-flop and said flip-flop outputs a flip-flop output signal on which the drive signal is dependent.

9. The circuit configuration according to claim 1, wherein said voltage regulator has a controllable resistor with a load path and a control input, said load path being connected between said input terminal and said output terminal, and said voltage regulator having a comparator configuration connected to and driving said controllable resistor in a manner dependent on a comparison of the output voltage with a reference voltage.

10. The circuit configuration according to claim 9, wherein said voltage regulator has a switch connected to and driving said controllable resistor, said switch being driven by the drive signal.

11. The circuit configuration according to claim 9, wherein said voltage regulator has a reference voltage source providing the reference voltage.

12. The circuit configuration according to claim 11, wherein said reference voltage source is driven by the drive signal.

13. A method for providing an output voltage from an input voltage, which comprises the steps of:

providing a linear voltage regulator that can be switched on and off, the linear voltage regulator outputting the output voltage in dependence on a reference voltage when switched on; and switching on and off the voltage regulator in a clocked manner according to a state signal assuming one of a first and second signal level, the state signal switching the linear voltage regulator on if the state signal assumes the first signal level and switching the linear voltage- regulator on and off in a clocked manner if the state signal assumes the second signal level.

14. The method according to claim 13, which further comprises:

switching on the voltage regulator if the output voltage has fallen to a threshold value; and switching off the voltage regulator for a predetermined time duration after a switch-on.

15. The method according to claim 13, which further comprises switching the voltage regulator on and off periodically according to an oscillator signal.

16. The method according to claim 13, which further comprises switching the voltage regulator on if the output voltage has fallen to a first threshold value, and switching off the voltage regulator if the output voltage has risen to a second threshold value.

* * * * *